US009410381B2

(12) United States Patent
Plain

(10) Patent No.: US 9,410,381 B2
(45) Date of Patent: Aug. 9, 2016

(54) RISER TENSION PROTECTOR AND METHOD OF USE THEREOF

(71) Applicant: Icon Engineering Pty Ltd, West Perth (AU)

(72) Inventor: Steven Plain, Burswood (AU)

(73) Assignee: ICON ENGINEERING PTY LTD, West Perth, Western Australia (AU)

( * ) Notice: Subject to any disclaimer, the term of this patent is extended or adjusted under 35 U.S.C. 154(b) by 0 days.

(21) Appl. No.: 14/520,628

(22) Filed: Oct. 22, 2014

(65) Prior Publication Data

US 2016/0060976 A1 Mar. 3, 2016

(30) Foreign Application Priority Data

Sep. 2, 2014 (AU) ..... 2014221195

(51) Int. Cl.

| | |
|---|---|
| ***E21B 19/00*** | (2006.01) |
| ***E21B 17/20*** | (2006.01) |
| ***E21B 19/22*** | (2006.01) |
| ***E21B 17/01*** | (2006.01) |

(52) U.S. Cl.

CPC ..... *E21B 19/006* (2013.01); *E21B 17/01* (2013.01); *E21B 17/20* (2013.01); *E21B 19/22* (2013.01)

(58) Field of Classification Search

CPC ..... E21B 19/006; E21B 19/004; E21B 19/22; E21B 19/09; E21B 17/01; E21B 17/20

USPC ..... 166/355, 367

See application file for complete search history.

(56) References Cited

U.S. PATENT DOCUMENTS

| | | | | |
|---|---|---|---|---|
| 3,839,976 | A | 10/1974 | Swenson et al. | |
| 4,799,827 | A * | 1/1989 | Jaqua | 405/224.4 |
| 5,775,845 | A * | 7/1998 | Wybro | 405/195.1 |
| 5,846,028 | A | 12/1998 | Thory | |
| 8,162,062 | B1 | 4/2012 | Barone et al. | |
| 8,347,982 | B2 * | 1/2013 | Hannegan et al. | 175/5 |
| 8,590,626 | B2 * | 11/2013 | Barone et al. | 166/355 |
| 2004/0099421 | A1 | 5/2004 | Trewhella | |
| 2005/0074296 | A1 | 4/2005 | McCarty | |
| 2005/0103500 | A1 * | 5/2005 | Trewhella | 166/355 |

(Continued)

FOREIGN PATENT DOCUMENTS

| | | |
|---|---|---|
| EP | 0 207 915 | 1/1987 |
| GB | 2515391 | 12/2014 |

OTHER PUBLICATIONS

Search Report dated Feb. 23, 2015 from corresponding Great Britian Application No. 1418794.2 (4 pages).

(Continued)

*Primary Examiner* — James G Sayre

(74) *Attorney, Agent, or Firm* — Brinks Gilson & Lione; G. Peter Nichols

(57) ABSTRACT

A riser tension protector and coiled tubing lift frame assembly including same for use as a backup heave compensator is described. The assembly includes a frame having an upper frame section adapted for attachment to a top drive system and a lower frame section adapted to interface with a flow-head assembly; and a pair of pneumatic cylinders spaced apart from one another. The pneumatic cylinders have a respective cylinder barrel and a piston rod translatable therein, a free end of the piston rods being fixed to the upper frame section and a lower end of the cylinder barrels being fixed relative to the lower frame section.

20 Claims, 8 Drawing Sheets

(56) References Cited

U.S. PATENT DOCUMENTS

| | | | | |
|---|---|---|---|---|
| 2012/0227976 | A1 | 9/2012 | Barone | |
| 2014/0034329 | A1* | 2/2014 | Skinnes et al. | 166/355 |

OTHER PUBLICATIONS

Patent Examination Report No. 1 dated Jan. 14, 2016 out of Australian priority Application No. 2014221195 (6 pages).

* cited by examiner

RISER TENSION PROTECTOR AND METHOD OF USE THEREOF

This application claims priority to Australian patent application No. 2014221195 filed on Sep. 2, 2014, the entire contents of which is incorporated herein by reference.

BACKGROUND

A riser tension protector and a coiled tubing lift frame assembly with over tension protection and back-up heave compensation are disclosed for use on floating drilling vessels such as drilling ships and semi-submersible drilling vessels.

As oil and gas offshore exploration and production operations are increasingly established in deeper waters, it has become more common for drilling activities to be performed from rigs that float on the surface of the water, such as drilling vessels or semi-submersible drilling rigs. Unlike fixed rigs or jack-up rigs, floating rigs are subject to wave motion, causing up-and down motion, which must be compensated for during drill, well completions, well testing, well interventions and other operations. Wave motion is of particular concern during "locked-to-bottom" operations (i.e., well completion, well testing and well intervention) where a completions workover riser or landing string (alternatively referred to as a 'riser') is physically connected to the subsea well at the seabed. It will be appreciated that, depending on the nature of the operations, the riser may be connected to a tubing hanger at the well-head, to a subsea tree or other infrastructure at the top of the well. Loss of heave compensation can lead to severe consequences.

Apart from the operational difficulties arising from the up-and-down motion of the floating rig, significant safety issues also arise, in particular the potential for the riser to fracture or buckle, resulting in loss of well containment and potential blowout. Indeed, safety standards in offshore operations demand that a heave compensation system be regarded as an essential component of a floating rig during locked-to-bottom operations.

Known heave compensation systems may be described as employing passive heave compensation or active heave compensation.

A simple passive heave compensator is a soft spring which effectively strokes in and out in response to string loads as the vessel heaves up and down while effectively holding constant tension on the string. Exemplary types of simple passive heave compensators are crown-mounted compensators or inline passive drill string compensators. Passive heave compensators employ hydraulic cylinders and associated gas accumulators to store and dissipate the energy as the vessel heaves up and down.

Active heave compensation differs from passive heave compensation by having an external control system with external inputs from motion reference units that actively tries to compensate for any movement at a specific point. Exemplary types of active heave compensation include active heave draw works which employ electric or hydraulic winch systems to raise and lower the top drive in response to the vessel motion.

Active-passive compensation systems consist of a primary passive compensation system with secondary actively driven hydraulic cylinders to reduce tension variations and improve efficiency. Two independent active and passive systems are generally not employed. The essential nature of the heave compensation function to a floating rig is such that safety standards also demand that they be designed such that no single component failure shall lead to overall failure of the system. They should also be "fail to safety" meaning that in the event of any predictable failures, the system defaults to a compensating state, which is the safest state during locked-to-bottom operations. While active heave draw works have numerous benefits for normal drilling operations, they fail to a "locked condition", which is undesirable for well completions, well testing and well intervention operations. Passive compensation systems (e.g. crown mounted compensators) are also not immune to failures. Safe operations and industry standards require additional means of safety to be implemented in the system/equipment configuration. Additional means of safety may include a standard in-line tensioner or traditional compensated coiled tubing lift frame, design of a weak link in the riser/landing string, weaklink bails, limiting operation parameters to be within the stretch limit of the riser, and so forth.

Generally, these operating parameters place constraints on operators which have direct impact on productivity and efficiency. All these existing options have limitations. In the case of a standard inline tensioner or conventional compensated coiled tubing lift frame, there are concerns about the how the system behaves when run in series with the active heave draw works. In the case of the weak link in the riser and weaklink bails, they typically only provide protection in an over-tensioned case and once broken, they provide no support to the landing string thereafter. In the case of limiting operating parameters to within the stretch of the riser, this can impose considerable downtime during offshore operations.

It would be advantageous to provide an inline tensioner or a back-up compensator which can be fully locked under normal operating loads so that it did not interfere with the operations of the primary compensator, but which is capable of automatic and rapid activation to provide compensation if axial load on the riser exceeds normal operation limits, which may occur in event of failure of the rig's primary compensator.

It would also be desirable to have an inline tensioner or a back-up compensator that may be actuated without the need for control valves to control fluid flow through fluid lines. Control valves add complexity into the back-up compensator, introducing additional failure points and restricting the actuation speed of the back-up compensator.

There is therefore a need for an alternative or improved heave compensation apparatus which may operate as a back-up to the rig's drill string compensator in the event of failure or disablement of the rig's drill string compensator.

There is also a need for an improved heave compensation apparatus which can be used as a lift frame for the installation of intervention pressure control equipment (i.e. coiled tubing or wireline equipment) during well testing/well intervention work, as those components are installed in the congested space of the drilling derrick.

The above references to background art do not constitute an admission that the art forms a part of the common general knowledge of a person of ordinary skill in the art. The above references are also not intended to limit the application of the heave compensation and tensioning apparatus as disclosed herein.

SUMMARY

Generally, a riser tension protector, a coiled tubing lift frame assembly including said riser tension protector, and a method of use thereof, are disclosed. The coiled tubing lift frame assembly may be employed as a back-up to a floating vessel's primary compensator in the event of failure or disablement of the rig's primary compensator. The primary compensator may be in the form of a crown mounted compensator, active heave drawworks, or other type of drill string compensator.

According to one aspect, there is disclosed a riser tension protector for a riser used in operations on a floating vessel, said protector comprising:

a pair of pneumatic cylinders spaced apart from one another, the pneumatic cylinders having a respective cylinder barrel and a piston rod translatable therein, a free end of the piston rods being operatively associated to a top drive system and a lower end of the cylinder barrels being fixed relative to a flowhead assembly;

wherein the pneumatic cylinders are charged to a pneumatic pressure sufficient to cause the piston rods to remain retracted and stationary in said barrels when an axial load on the riser is under a predetermined operating load threshold and to extend on an upheave of the floating vessel when the axial load on the riser exceeds the predetermined operating load threshold.

In the event of failure of the rig's primary compensator on an up heave of the floating vessel, the axial load may increase to or above the predetermined operating load threshold, causing the piston rods to automatically extend in said barrels. On a subsequent down heave of the floating vessel, the piston rods will retract in said barrels in response to a decreasing axial load on the riser. The piston rods may then remain retracted and stationary within the barrels until the predetermined operating load threshold is exceeded again.

It will be appreciated that the pneumatic pressure charged to the pneumatic cylinders and the predetermined operating load threshold may be varied to suit the planned operation.

In one embodiment, the pneumatic cylinders are arranged to be in fluid communication with one another in a manner whereby the pneumatic pressure in each cylinder is the same. The provision of the same pneumatic pressure in each cylinder ensures that the respective piston rods extend simultaneously in response to the axial load.

In another embodiment, the piston rods may be hollow. The hollow piston rod may define a cylindrical cavity. The cylindrical cavity may also be charged to the same pneumatic pressure as the pneumatic cylinders. The cylindrical cavity of the hollow piston rod may be in fluid communication with a rod side of the cylinder barrel via one or more apertures in a piston rod wall. The rod side of the cylinder barrel defines an annular cavity. The annular cavity may be charged to the pressure sufficient to cause the piston rods to remain retracted in said barrels when the axial load on the riser is under the predetermined operating load threshold.

In a further embodiment, respective upper ends of the cylinder barrels may be interconnected by a cross member. The free ends of the piston rods may be fixed to an upper frame section adapted for attachment to the top drive system.

According to a second aspect, there is disclosed a coiled tubing lift frame assembly, said assembly comprising:

a frame having an upper frame section adapted for attachment to a top drive system and a lower frame section adapted to interface with a flowhead assembly;

a pair of pneumatic cylinders spaced apart from one another, the pneumatic cylinders having a respective cylinder barrel and a piston rod translatable therein, a free end of the piston rods being fixed to the upper frame section and a lower end of the cylinder barrels being fixed to the lower frame section;

wherein the pneumatic pressure in said cylinders is charged to a pressure sufficient to cause the piston rods to remain retracted and stationary in said barrels when an axial load on the riser is under a predetermined operating load threshold and to extend on an upheave of the floating vessel when the axial load exceeds the predetermined operating load threshold.

The upper frame section may be attached to the top drive system by means of coupling elements, such as elevator bails.

In one embodiment, the lower ends of the cylinder barrels may be fixed to the lower frame section by means of coupling elements, such as elevator bails. In an alternative embodiment, the lower ends of the cylinder barrels may be fixed directly to the lower frame section. In this particular embodiment, the lower end of the cylinder barrel may define a rigid section. In these embodiments, respective upper ends of the cylinder barrels may be interconnected by a cross member.

The disclosure also describes a method for providing back up compensation for a riser used in operations on a floating vessel in the event of failure of, or operability issues with, a primary compensator, the method comprising:

providing the riser tension protector as defined above;

locating the pair of pneumatic cylinders of the riser tension protector between the top drive system and the flow head assembly in a manner whereby the free ends of the piston rods are operatively associated with the top drive system and the lower ends of the cylinder barrels are fixed relative to the flow head assembly;

charging the cylinders to a pneumatic pressure sufficient to cause the piston rods to remain retracted and stationary in said barrels when an axial load on the riser is under a predetermined operating load threshold and to extend on an upheave of the floating vessel when the axial load on the riser exceeds the predetermined operating load threshold; and, in the event of failure of, or operability issues with, the rig's primary compensator and the axial load on the riser exceeding the predetermined operating load threshold, allowing the piston rods to extend to compensate for an upheave of the floating vessel.

In one embodiment the piston rods may be purposefully extended to a mid-stroke position so that the piston rods may extend or retract, respectively, thereby providing compensation on both an up heave and a down heave, respectively, maintaining relatively constant axial load on the riser. Axial load variations are compensated for by gas compression and expansion in the cylinders.

It will be appreciated that if the piston rods are purposefully extended to the mid-stroke position, the axial tension will increase as the piston rods extend. The riser tension protector is configured to allow an operator to remotely decrease the pneumatic pressure in the cylinders to reduce the axial load lower than the predetermined operating load threshold. Similarly, the pneumatic pressure in the cylinders may be increased by a remote operator.

BRIEF DESCRIPTION OF THE DRAWINGS

Notwithstanding any other forms which may fall within the scope of the riser tension protector and coiled tubing frame assembly as set forth in the Summary, specific embodiments will now be described, by way of example only, with reference to the accompanying drawings in which.

DETAILED DESCRIPTION

Embodiments of a riser tension protector for a riser used in operations on a floating vessel and a coiled tubing lift frame assembly will now be described by way of example only, and with particular (though not exclusive) reference to drilling and completions for oil and gas reserves offshore.

Figure 1:
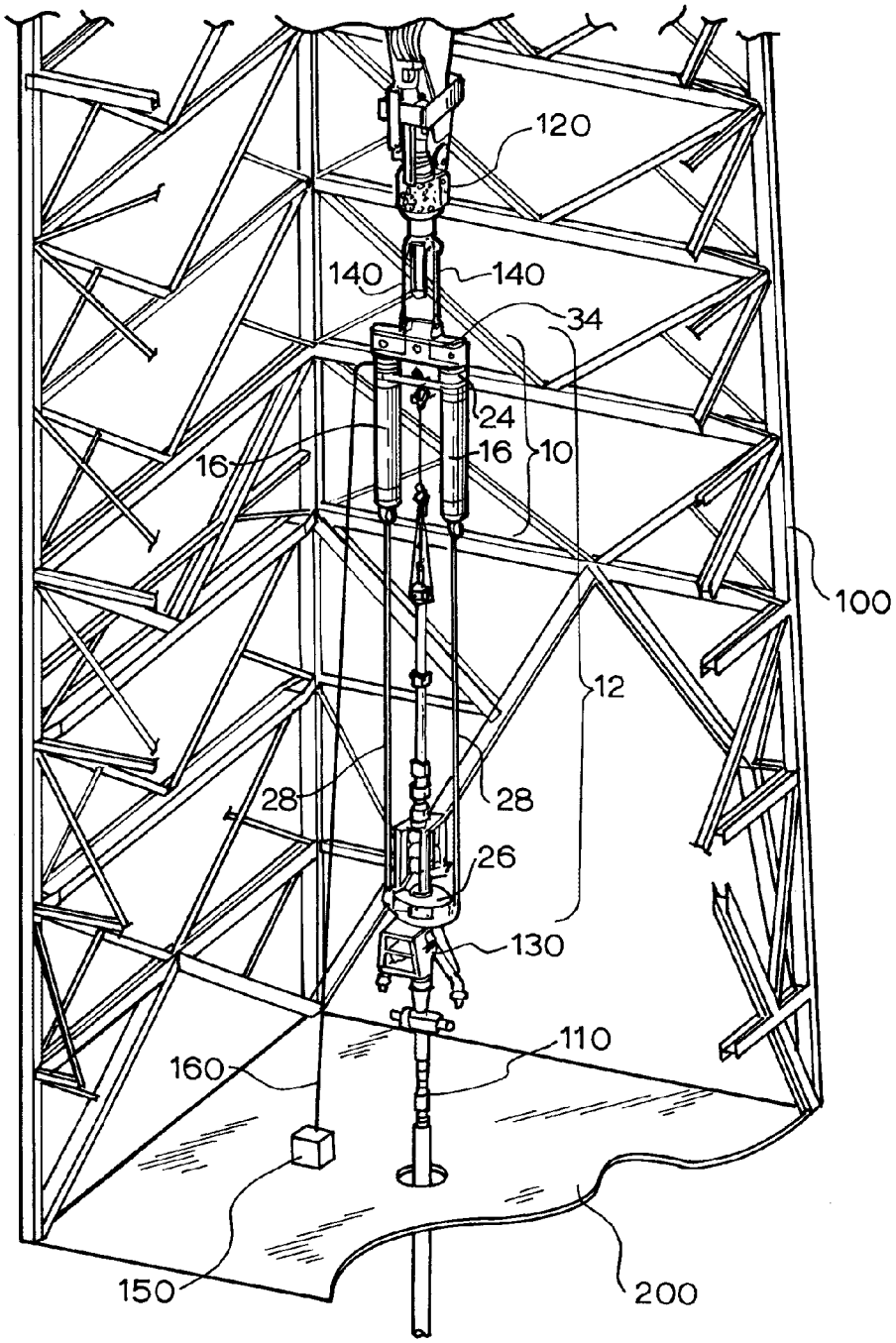
FIG. 1 is a partial schematic representation of a derrick and drill floor of a floating vessel showing a riser tension protector and coiled tubing lift frame assembly in accordance with one embodiment configured in-line with various components used in locked-to-bottom operations for oil and gas reserves offshore.
Figure 9:
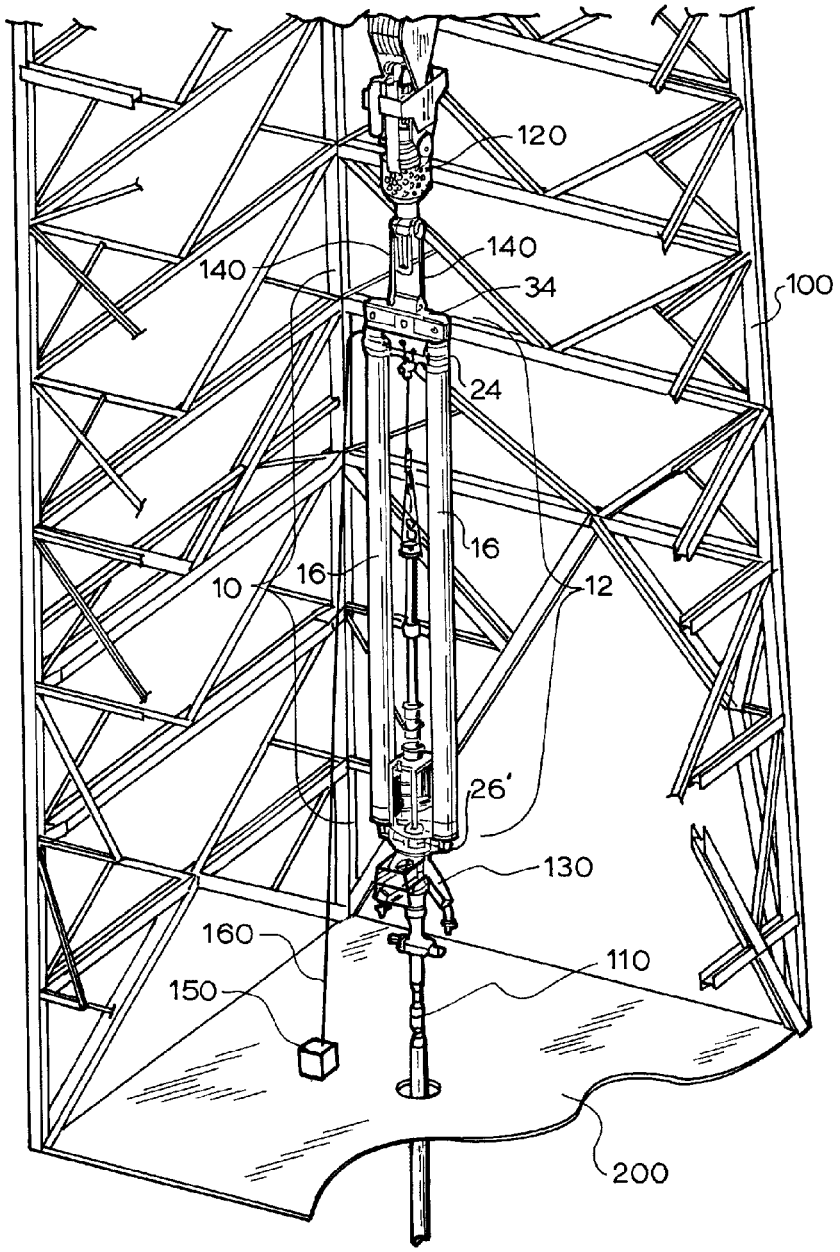
FIG. 9 is a partial schematic representation of a derrick and drill floor of a floating vessel showing a riser tension protector and a coiled tubing lift frame assembly in accordance with an alternative embodiment configured in-line with various components used in locked-to-bottom operations for oil and gas reserves offshore.

Referring to FIGS. 1 and 9, there is shown a partial and schematic view of a derrick 100 and a drill floor 200 of a floating vessel used in locked-to-bottom operations for oil and gas production offshore. The derrick 100 extends upwardly above the drill floor 200 and supports the main hoisting and drilling components used in drilling operations.

The derrick 100 may support a hoisting assembly, such as a block and tackle, for raising and lowering a completions/workover riser or landing string 110 (alternatively referred to as a 'riser') which may be configured to pass through the drill floor 200 and facilitate well completions/well testing/well intervention of a subsea production well. A lower end of the riser 110 may be fixed to the wellhead at the seafloor by means of a tubing hanger in what may be termed 'locked-to-bottom' operations. The upper end of the riser may be fixed to a flowhead assembly 130 above the drillfloor 200. A top drive system 120 may be provided to also facilitate lowering or lifting of the riser 110.

The hoisting assembly may be provided with a primary heave compensator. The primary heave compensator may be an active heave drawworks system or a passive heave compensator mounted on the top of the derrick 100. As discussed above, if this primary heave compensator fails or becomes inoperative, the fluctuation in the vertical position of the floating vessel relative to the seafloor due to wave motion will place the riser 110 under alternating compression and tension.

The riser tension protector 10 and the coiled tubing lift frame assembly 12, in the embodiment described herein, provides a back-up or secondary heave compensator which is configured to compensate for excessive axial load on the riser 110 in an upheave of the floating vessel when the primary heave compensator fails. This particular embodiment provides 'over tension protection'.

The coiled tubing lift frame assembly 12 incorporates the riser tension protector 10 and may be configured in-line below the rig's primary heave compensation system. The coiled tubing lift frame assembly 12 may be operatively associated at one end thereof with the top drive system 120 and fixed relative to the flowhead assembly 130. Installed in this way, the coiled tubing lift frame assembly 12 may be suspended above the drill floor 200 of the floating vessel.

In normal inline operation, the coiled tubing lift frame assembly 12 may be disposed in a fixed length mode, as will be described later whereby respective piston rods of the pneumatic cylinders of the riser tension protector 10 remain stationary and substantially fully retracted in respective cylinder barrels, and the primary heave compensator accounts for the heave of the floating vessel. In the event of failure of the primary heave compensator, however the piston rods of the pneumatic cylinders automatically extend to prevent excessive axial load on the riser 110 in response to an upheave of the vessel.

Figure 2:
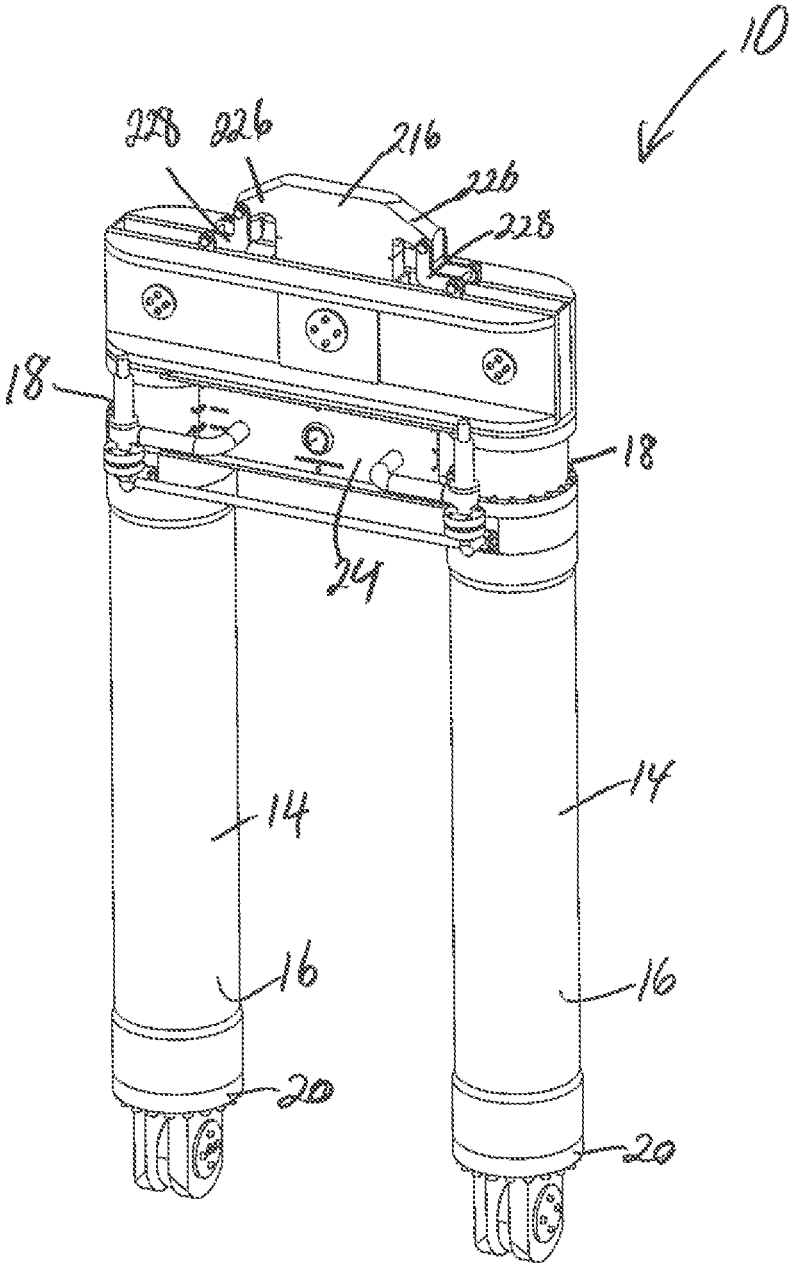
FIG. 2 is a schematic representation of a riser tension protector for a floating vessel in accordance with the disclosure, wherein the piston rods of said protector are shown fully retracted.
Figure 3:
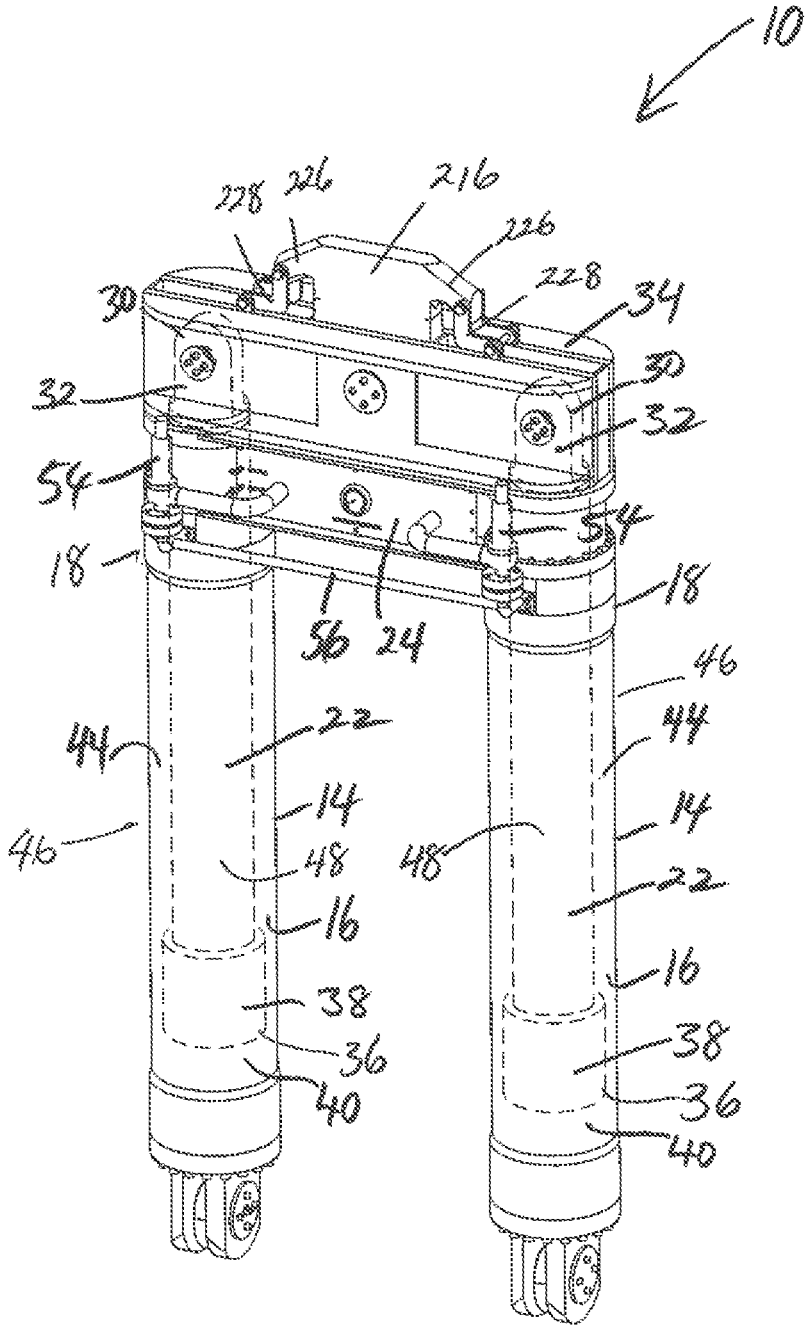
FIG. 3 is a schematic representation of the riser tension protector shown in FIG. 2 with piston rods shown in phantom.
Figure 4:
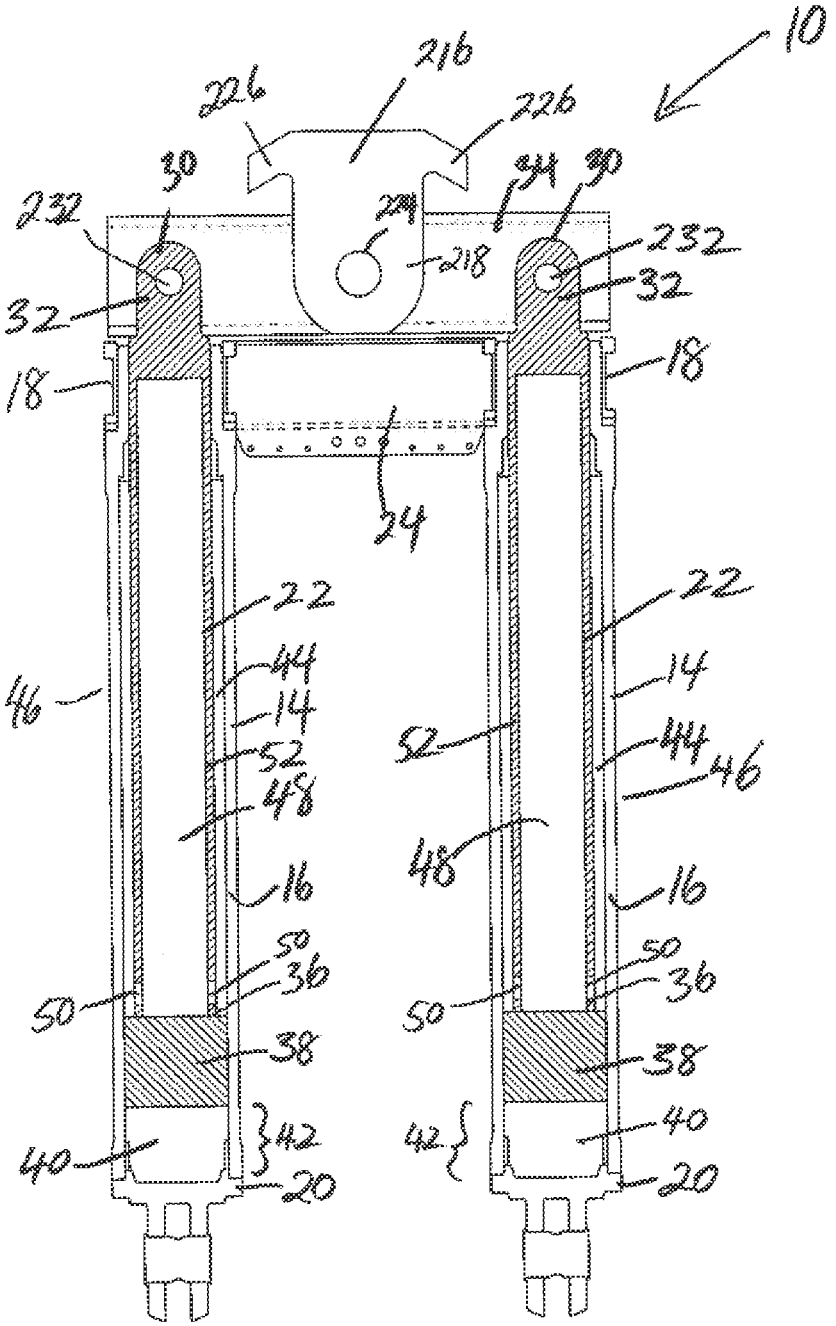
FIG. 4 is a longitudinal cross-sectional representation of the riser tension protector shown in FIGS. 2 and 3.

Referring generally to FIGS. 2 to 4, where like reference numerals refer to like parts throughout, there is shown the riser tension protector 10 as described herein.

The riser tension protector 10 includes a pair of pneumatic cylinders 14 spaced apart from one another. Each pneumatic cylinder 14 has a cylinder barrel 16 having an upper end 18 and a lower end 20, and a piston rod 22 translatable within the cylinder barrel 16 between a retracted mode and an extended mode. In some embodiments, the piston rod 22 may have a stroke of up to 3 m, even up to 4.5 m, the fully extended mode being defined by a physical end stop of the cylinder barrel 16. Under normal operating conditions, whereby the primary heave compensator is operable, the piston rods 22 may remain retracted and stationary in the cylinder barrel 16. In the event of failure of the primary heave compensator and in response to a load on the riser 110 in excess of a predetermined axial load, however, the piston rods 22 may extend to prevent excessive tension on the riser 110 on an upheave of the vessel, and will subsequently retract on a down heave of the vessel.

The upper ends 18 of the cylinder barrels 16 are interconnected by a cross member 24, as will be described in more detail with reference to FIG. 6. The cross member 24 provides rigid structural support for the pair of pneumatic cylinders 14.

The lower ends 20 of the cylinder barrels 16 are arranged, in use, to be fixed relative to a flowhead assembly 130, preferably by means of a lower frame section 26, 26' adapted to couple to the flowhead assembly 130, as will be described in more detail with reference to FIGS. 7 and 8. In one embodiment, as shown in FIG. 1, the lower ends 20 of the cylinder barrels 16 are fixed to the lower frame section 26 by coupling elements 28. In an alternative embodiment, as shown in FIG. 9, the lower ends 20 of the cylinder barrels 16 may be fixed directly to the lower frame section 26'.

The piston rod 22 has a free end 30 with a clevis 32 associated therewith. In use, the clevis 32 of each piston rod 22 is operatively associated with an upper frame section 34, as will be described in more detail with reference to FIG. 5.

An opposing end 36 of the piston rod 22 is associated with a piston head 38. The piston head 38 is translatable within the cylinder barrel 16, thereby defining a first pneumatic chamber 40 on a blind side 42 of the cylinder barrel 16 and a second pneumatic chamber 44 on a rod side 46 of the cylinder barrel 16. The first pneumatic chamber 40 will generally define a cylindrical cavity in the cylinder barrel 16 and the second pneumatic chamber 44 will generally define an annular cavity in the cylinder barrel 16. It will be appreciated that the volume of the first and second pneumatic chambers 40, 44 will vary depending on the stroke of the piston rod 22.

The piston rod 22 may be hollow, defining a third pneumatic chamber 48 therein. The third pneumatic chamber 48 may be in fluid communication with the second pneumatic chamber 44 via one or more apertures 50 in a piston rod wall 52.

The first pneumatic chamber 40 on the blind side 42 of the cylinder barrel 16 has a low pneumatic pressure in a range of 0.5 bar to 10 bar, depending on the stroke length. The second and third pneumatic chambers 44, 48 on the rod side 46 of the cylinder barrel 16 and within the piston rod 22, respectively, are charged with a relatively higher pneumatic pressure than the first pneumatic chamber 40.

The pneumatic pressure in the second and third pneumatic chambers 44, 48 may be sufficient to cause the piston rods 22 to remain retracted and stationary in the cylinder barrels 16 when an axial load on the riser is under a predetermined operating load threshold. When the axial load on the riser exceeds the predetermined operating load threshold, for example if the primary heave compensator fails on an upheave of the floating vessel or the upheave of the vessel exceeds the normal operating swell, in response thereto the piston rods 22 extend, thereby preventing excessive axial load on the riser 110. In these particular embodiments, in the fully retracted mode the pneumatic pressure in the second and third pneumatic chambers 44, 48 may be in a range of 150-200 bar. In an extended mode, the pneumatic pressure in the second and third pneumatic chambers 44, 48 may increase up to 280 bar. In some embodiments, the second pneumatic chamber 44 on the rod side of the cylinder barrel 16 may be provided with one or more pressure relief valves 54 to vent pressure at a pre-set value, allowing the piston rods to extend while maintaining constant pressure in the second and third pneumatic chambers 44, 48 and hence constant axial load on the riser on an up heave of the floating vessel.

Following the upheave of the vessel, subsequently on a down heave of the vessel the axial load on the riser may reduce to or below the predetermined operating load threshold, thereby allowing the piston rods 22 to retract into the cylinder barrels 16. It will be appreciated that the pneumatic pressure in the second and third pneumatic chambers of the cylinder barrels 16 and the predetermined operating load threshold may be varied to suit the planned operation.

The pneumatic cylinders 14 may be arranged to be in fluid communication with one another in a manner whereby the pneumatic pressure in the second and third pneumatic chamber 44, 48 of each cylinder 14 is the same. Fluid communication between the spaced apart pneumatic cylinders 14 may be provided by a conduit 56 extending between and interconnecting the second pneumatic chambers 44 of the cylinder 14. Advantageously, the provision of the same pneumatic pressure in each cylinder 14 ensures that the respective piston rods 22 retract or extend simultaneously in response to the axial load on the riser.

The pneumatic cylinders 14 may be in intermittent fluid communication with a control unit 150 typically located on the drill floor 200 via an umbilical 160. The control unit 150 is configured to provide an air fill function to the pneumatic cylinders 14 via a hose (contained within the umbilical 160). Air fill may be provided by the rig's high pressure air supply or by standalone high pressure air vessels on the deck, regulated to provide the desired pneumatic pressure to the pneumatic cylinders 14. The control unit 150 may also be configured to provide an air vent function which is remotely operable via the control unit 150 with a pilot hose to the pneumatic cylinder 14. The pilot hose may be contained within the umbilical 160. The air vent may be associated with double pilot actuated isolation ball valves, spring applied to close, and a silencer. The air vent may be associated with an inline orifice on the vent line to limit vent rate. Further, the double pilot actuated isolation valves may be configured to provide a local manual override to provide a manual air bleed function. It will be appreciated that under normal operating conditions, the hose need not be connected to the pneumatic cylinders 14 as high pressure air adjustment is not normally required. It is envisaged that hoses will only need to be connected in the event that a remote air fill/vent is required.

The coiled tubing lift frame assembly 12 includes the riser tension protector 10 described herein. The coiled tubing lift frame assembly 12 includes a frame with the upper frame section 34 adapted for attachment to the top drive system 120 and the lower frame section 26 which is adapted to interface with the flowhead assembly 130. The free ends of the piston rods 22 of the riser tension protector 10 are fixed to the upper frame section 34 as will be described below. The lower frame section 26 may be adapted for fixing the lower ends 20 of the cylinder barrels 16 by means of coupling elements 28, such as elevator bails, as shown in FIG. 1 and in more detail in FIG. 8. Alternatively, the lower frame section 26' may be adapted so that the lower ends 20 of the cylinder barrels 16 may be directly fixed thereto, as shown in FIGS. 8 and 9.

Figure 5:
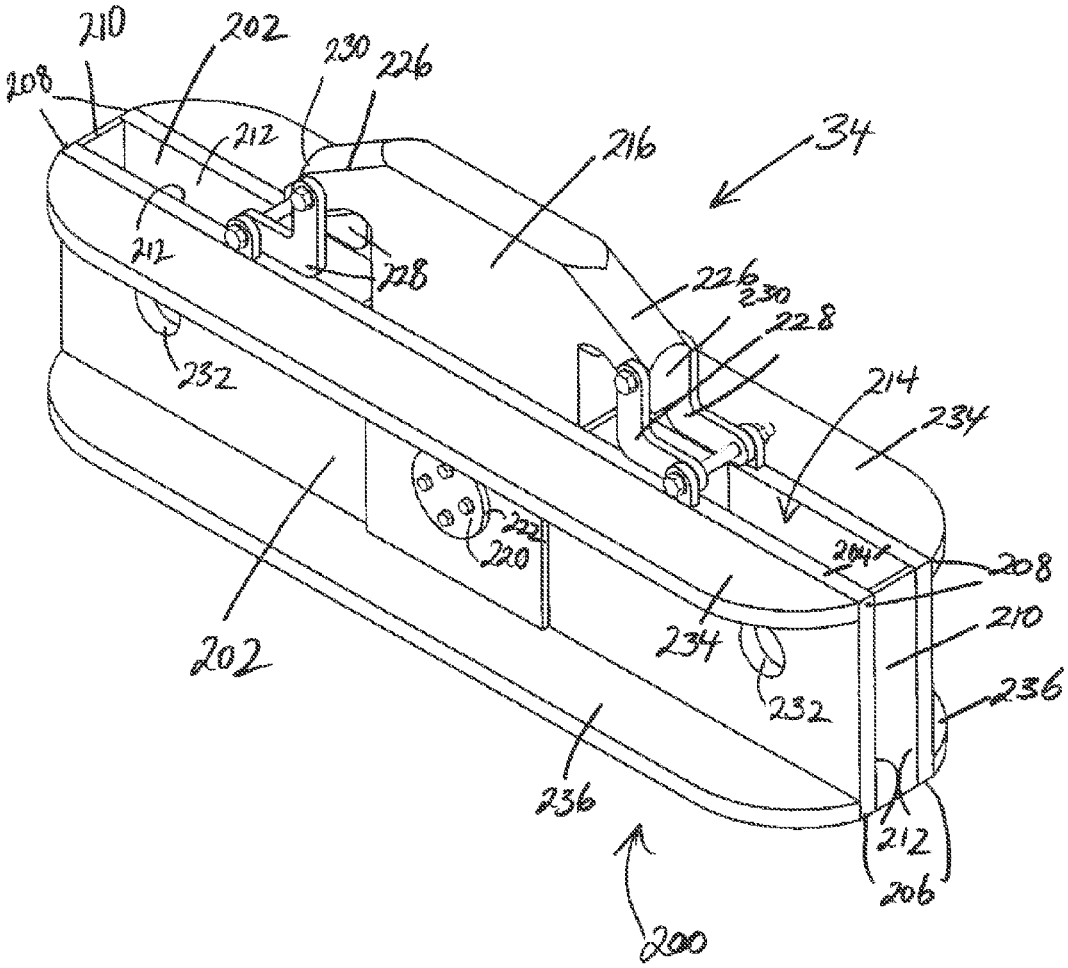
FIG. 5 is a perspective view of an upper frame section of the riser tension protector shown in FIGS. 1-4.

Referring now to FIG. 5, there is shown a detailed perspective view of the upper frame section 34 of the riser tension protector 10 and coiled tubing lift frame assembly 12. The upper frame section 34 is adapted for attachment to the top drive system 120 via coupling elements 140, such as elevator links.

The upper frame section 34 comprises a cross member 200 in the form of a spreader beam. The cross member 200 may be a pair of parallel plates 202 spaced apart from one another. Each plate 202 has an upper edge 204, a lower edge 206, and opposing side edges 208. An end plate 210 extends between respective internal faces 212 of the parallel plates 202 at opposing side edges 208, thereby defining a cavity 214 between the pair of parallel plates 202.

The upper frame section 34 further comprises an attachment member 216 in the form of a lug. In this embodiment, the attachment member 216 upwardly extends from the upper edge 204 of the cross member 200 and is disposed substantially equidistantly from the opposing side edges 208 of the cross member 200.

In some embodiments, the attachment member 216 may be integrally formed with the parallel plates 202 of the cross member 200 or may be welded to the parallel plates 202.

However, in the particular embodiment shown in FIG. 5, the attachment member 216 has a body 218 that is inserted into the cavity 214 between the pair of parallel plates 202 and secured therebetween by fasteners 220. The fasteners 220 may take the form of a pin that is inserted through correspondingly aligned apertures 222, 224 in the parallel plates 202 and the body 218 of the attachment member 216, respectively. Advantageously, this particular arrangement provides the attachment member 216 with limited rotation, helping to reduce member forces on the attachment member 216 due to unequal bail lengths and skew loading thereon.

The attachment member 216 may be configured to be coupled to the top drive system 120 by various coupling elements 140, such as bail arms or elevator links. In this embodiment, the attachment member 216 is provided with a pair of downwardly inclined ears 226 spaced from the upper edge 204 of the cross member 200. In use, as shown in FIG. 1, respective lower ends of the bail arms 140 are engaged with the downwardly inclined ears 226 while respective upper ends of the bail arms 140 are coupled to the top drive system 120.

In one particular embodiment, maintaining engagement of the lower ends of the bail arms with the downwardly inclined ears 226 may be achieved with a retainer 228 in the form of a pair of L-shaped brackets. In use, after engagement of the bail arms 140 with the downwardly inclined ears 226, the arms of the L-shaped brackets may be connected (such as with bolts, threaded screws, and so forth), respectively, to the upper edge 202 of respective parallel plates 202 and side edges 230 of the downwardly inclined ears 226. In this way, if there is a recoil event or the load decreases, the lower ends of the bail arms are prevented from disengaging the downwardly inclined ears 226 and, consequently, the upper frame section 34 is prevented from detaching from the top drive system 120.

The upper frame section 34 is also adapted to be operatively associated with the piston rods 22 of the cylinders 14. The parallel plates 202 of the cross member 200 may be provided with a pair of apertures 232. Each aperture 232 is spaced apart from opposing side edges 208 of the cross member 200. The apertures 232 are configured, in use, to receive a pin which is inserted through a respective clevis 32 associated with the free end 30 of the piston rod 22 of the cylinder 14, thereby fixing the free end 30 of the piston rod 22 to the upper frame section 34.

The upper frame section 34 may also comprise a first pair of opposing plates 234 laterally extending from the parallel plates 202 of the cross member 200 and a second pair of opposing plates 236 laterally extending from the parallel plates 202 of the cross member 200. The first pair of opposing plates 234 is disposed adjacent to the upper edge 204 of the parallel plates 202. The second pair of opposing plates 236 is disposed adjacent to the lower edge 206 of the parallel plates 202.

Figure 6:
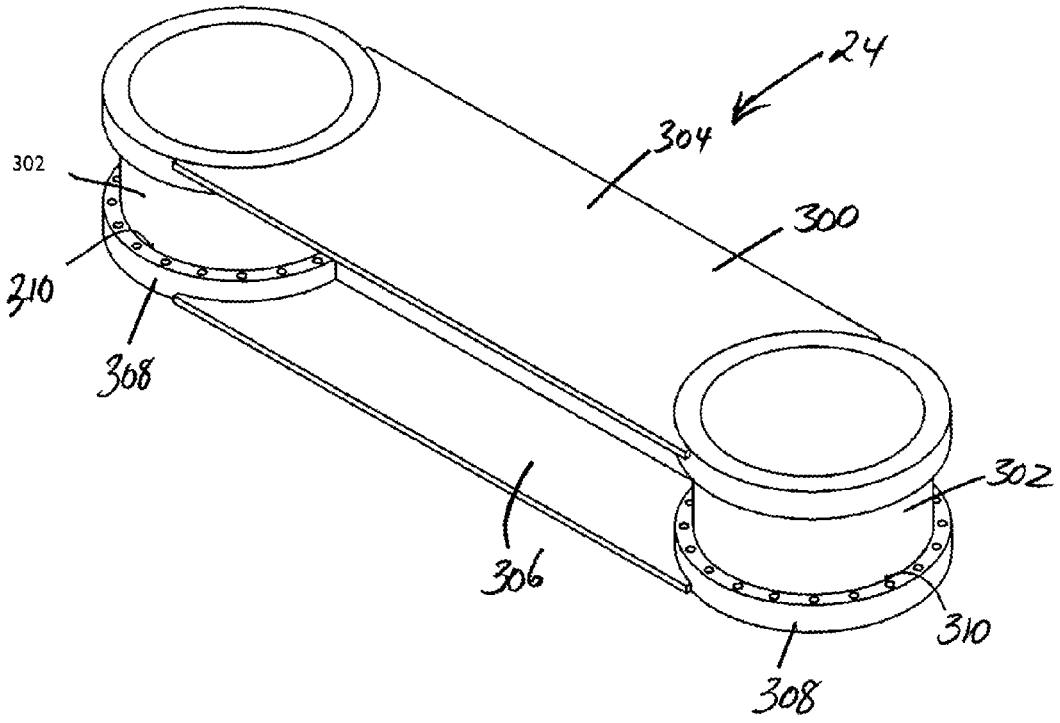
FIG. 6 is a perspective view of a cross beam section of the riser tension protector shown in FIGS. 1-4.

Referring now to FIG. 6, there is shown a detailed perspective view of the cross member 24 of the riser tension protector 10. In this particular embodiment, the cross member 24 takes the form of a spreader beam 300.

The cross member 24 comprises a pair of spaced apart hollow cylindrical members 302 interconnected by an upper plate 304 and a lower plate 306.

The cylindrical members 202 are each provided with a flange 308 concentrically disposed at a lower end 310 thereof. The cylindrical members 302 are spaced apart from one another such that the flanges 308 are configured, in use, to receive and couple with respective upper ends of the cylinders 14 so that the piston rods 22 of the cylinders 14 may reciprocally translate concentrically within the hollow cylindrical members 302. In this way, the intermediate member 300 provides structural rigidity to the cylinders 14.

The upper plate 304 is disposed at respective upper ends 312 of the hollow cylindrical members 302. In use, when the piston rods 22 are fully retracted, the upper plate 304 provides a landing for the upper frame section 34, as shown in FIGS. 1-3.

Figure 7:
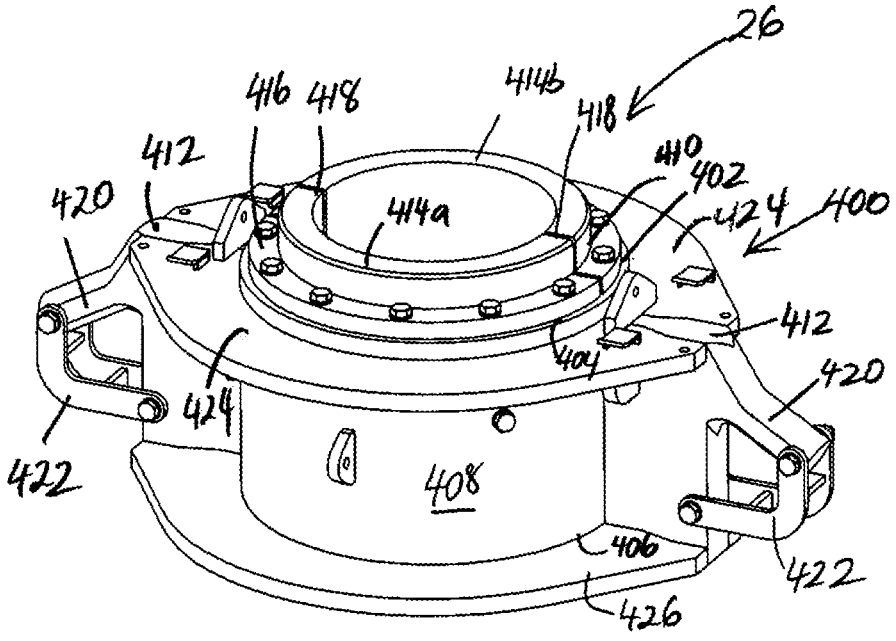
FIG. 7 is a perspective view of one embodiment of a lower frame section of the coiled tubing frame assembly shown in FIGS. 1-6.

Referring now to FIG. 7, there is shown a detailed perspective view of the lower frame section 26 of the coiled tubing lift frame assembly 12. In this particular embodiment, the lower frame section 26 is adapted to be connected to the cylinders 14 of the riser tension protector 10 by means of coupling elements 280 such as long bails or elevator links.

The lower frame section 26 comprises a cross member 400 in the form of a spreader beam. The cross member 400 comprises a cylindrical member 402 having an upper edge 404, a lower edge 406, an outer cylindrical wall 408, and an inner cylindrical wall 410. The lower frame section 26 also comprises a pair of opposing side plates 412 outwardly extending from respective opposing sides of the outer cylindrical wall 408.

The lower frame section 26 further comprises a pair of split insert members 414 which are locked in place by a collar member 416. The split insert members 414 comprise a pair of semi-cylindrical members 414*a*, 414*b* which are disposed to abut each other at facing edges 418 thereof. The cylindrical members 414*a*, 414*b* are concentrically disposed to abut the inner cylindrical wall 410 of the cylindrical member 402. The pair of split inserts 414*a*, 414*b* is advantageously formed to interface with any one of a plurality of general flowhead assemblies 130. The collar member 416 is advantageously formed with a wedge type cross section, holding the split inserts 414 securely with the cylindrical member 402 in tension without the need for additional securing bolts.

In use, the flowhead assembly 130 is interfaced with the lower frame section 26 by coupling the flowhead assembly 130 with the split inserts 414 and the collar member 416 proximal to the lower edge 406 of the cylindrical member 402. In this way, the lower section 26 is capable of locking directly to the flowhead assembly 130.

The lower frame section 26 may be also adapted to engage the cylinders 14. The cross member 400 may be provided with a pair of downwardly depending ears 420. The downwardly depending ears 420 outwardly extend from the opposing side plates 412 in longitudinal alignment therewith. In use, as shown in FIG. 1, respective lower ends of the bail arms 28 are engaged with the downwardly inclined ears 420 while respective upper ends of the bail arms 28 are coupled to the lower ends of the cylinder barrels.

In one particular embodiment, maintaining engagement of the lower ends of the bail arms with the downwardly inclined ears 420 may be achieved with a retainer 422 in the form of a pair of L-shaped brackets. In use, after engagement of the bail arms 28 with the downwardly inclined ears 420, the arms of the L-shaped brackets 422 may be connected (such as with bolts, threaded screws, and so forth), respectively, to the opposing side plates 412 and the downwardly inclined ears 420.

The lower frame section 26 may also comprise a first pair of opposing plates 424 laterally extending from the cylindrical member 402 and the side plates 412 of the cross member 400 and a second pair of opposing plates 426 laterally extending from the cylindrical member 402 and the side plates 412 of the cross member 400. The first pair of opposing plates 424 is disposed adjacent to the upper edge 404 of the cylindrical member 402. The second pair of opposing plates 426 is disposed adjacent to the lower edge 406 of the cylindrical member 302.

Figure 8:
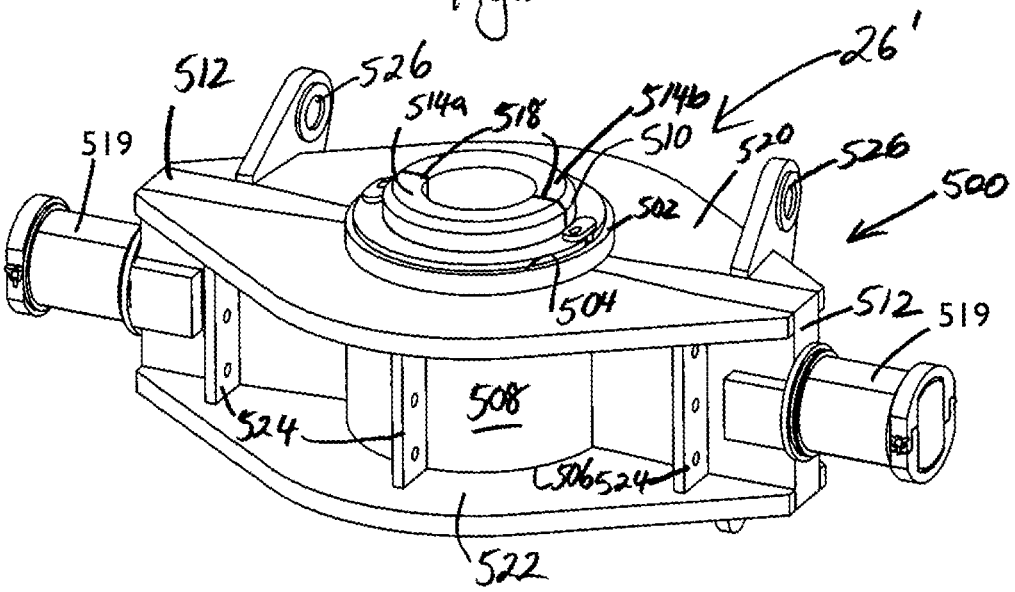
FIG. 8 is a perspective view of another embodiment of a lower frame section of the coiled tubing frame assembly shown in FIG. 9.

Referring now to FIG. 8, there is shown a detailed perspective view of the lower frame section 26' of the coiled tubing lift frame assembly 12. In this particular embodiment, the lower frame section 26' is adapted to be directly connected to the cylinders 14 of the riser tension protector 10.

The lower frame section 26' comprises a cross member 500 in the form of a spreader beam. The cross member 500 comprises a cylindrical member 502 having an upper edge 504, a lower edge 506, an outer cylindrical wall 508, and an inner cylindrical wall 510. The lower frame section 26' also comprises a pair of opposing side plates 512 outwardly extending from respective opposing sides of the outer cylindrical wall 508. The side plates 512 may be outwardly tapering.

The lower frame section 26' further comprises a pair of split insert members 514 which are locked in place by a collar member. The split insert members 514 comprises a pair of semi-cylindrical members 514*a*, 514*b* which are disposed to abut each other at facing edges 518 thereof. The cylindrical members 514*a*, 514*b* are concentrically disposed to abut the inner cylindrical wall 510 of the cylindrical member 502. The pair of split inserts 514 is advantageously formed to interface with any one of a plurality of general flowhead assemblies 130. The collar member is advantageously formed with a wedge type cross section, holding the split inserts 514 securely with the cylindrical member 502 in tension without the need for additional securing bolts.

In use, the flowhead assembly 130 is interfaced with the lower frame section 26' by coupling the flowhead assembly 130 with the split inserts 514 and the collar member proximal to the lower edge 506 of the cylindrical member 502. In this way, the lower frame section 26' is capable of locking directly to the flowhead assembly 130.

The lower frame section 26' may be also adapted to directly engage the cylinders 14. The cross member 500 may be provided with a pair of opposing shafts 519. The shafts 519 outwardly extend from the opposing side plates 512 in longitudinal alignment therewith. In use, the shafts 519 are configured to engage the spherical bearings in the lower end of the cylinders 14 in a manner whereby the cylinders 14 are directly fixed to the lower frame section 26'.

The lower frame section 26' may also comprise a first pair of opposing plates 520 laterally extending from the cylindrical member 502 and the side plates 512 of the cross member 500 and a second pair of opposing plates 522 laterally extending from the cylindrical member 502 and the side plates 512 of the cross member 500. The first pair of opposing plates 520 is disposed adjacent to the upper edge 504 of the cylindrical member 502. The second pair of opposing plates 522 is disposed adjacent to the lower edge 506 of the cylindrical member 502. A plurality of substantially vertical brace members 524 may extend between the first and second pairs of plates 520, 522 to provide additional strength and rigidity to the lower frame section 26' and to provide additional handling points. The vertical brace members 524 may be equidistantly spaced with respect to one another.

The lower frame section 26' may be further provided with a pair of load bearing lugs 526 in the form of padeyes. The load bearing lugs 526 upwardly extend from the first pair of opposing plates 520. The load bearing lugs 526 may be integrally formed with substantially vertical brace members 524 extending between the first and second pairs of opposing plates 520, 522. The load bearing lugs 526 and the vertical brace members 524 are equidistantly spaced apart from opposing sides of the cross member 500. Advantageously, the load bearing lugs 526 may be used to lift the coiled tubing lift frame assembly 12.

In use, the riser tension protector 10 and the coiled tubing lift frame assembly 12 may be employed as a backup compensator for a primary compensator in the form of a drill string compensator. The coiled tubing lift frame assembly 12 may be installed by first charging the pneumatic pressure of the pneumatic cylinders to a pressure sufficient to cause the piston rods 22 of the cylinders 14 to remain fully within the cylinder barrels under normal operating conditions (i.e. under normal swell). The upper frame section may then be coupled to the top drive system 120 by various couplers, such as bail arms or elevator links 140. The flowhead assembly 130 may then be interfaced with the lower frame section 26 by coupling the flowhead assembly 130 with the split inserts and the collar member proximal to the lower edge of the spreader beam.

In the event of the rig's drill string compensator failing, on an upheave of the floating vessel the axial load on the riser may exceed a predetermined operating threshold load. In these circumstances, the piston rods 22 in the cylinders 14 will extend in response to, and to compensate for, heave of the vessel.

Numerous variations and modifications will suggest themselves to persons skilled in the relevant art, in addition to those already described, without departing from the disclosure. All such variations and modifications are to be considered within the scope of the disclosure.

For example, the piston rods 22 of the pneumatic cylinders 14 may be solid. Consequently, in this alternative embodiment, the pneumatic cylinders 14 are not provided with a third cylindrical cavity whose pneumatic pressure may be charged at an overpressure.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A riser tension protector for a riser used in operations on a floating vessel comprising:

a pair of pneumatic cylinders spaced apart from one another, the pneumatic cylinders having a respective cylinder barrel and a piston head and a piston rod translatable therein, a free end of the piston rods being operatively associated to a top drive system and a lower end of the cylinder barrels being fixed relative to a flowhead assembly;

wherein the pneumatic cylinders are charged with a pneumatic pressure sufficient to cause the piston rods to remain fully retracted and stationary in the barrels when an axial load on the riser is under a predetermined operating load threshold and to extend on an upheave of the floating vessel when the axial load on the riser exceeds the predetermined operating load threshold.

2. The riser tension protector according to claim 1, wherein the pneumatic cylinders are arranged to be in fluid communication with one another in a manner whereby the pneumatic pressure in each cylinder is the same.

3. The riser tension protector according to claim 2, whereby the piston rods retract or extend simultaneously in response to the axial load.

4. The riser tension protector according to claim 1, wherein the piston rods are hollow, thereby defining a cylindrical cavity.

5. The riser tension protector according to claim 4, wherein the pneumatic pressure in the cylindrical cavity is charged to the same pneumatic pressure as a rod side of the cylinder barrel.

6. The riser tension protector according to claim 5, wherein the hollow piston rod is in fluid communication with the rod side of the cylinder barrel via one or more apertures in a piston rod wall.

7. The riser tension protector according to claim 5, wherein the rod side of the cylinder barrel defines an annular cavity.

8. The riser tension protector according to claim 7, wherein the pneumatic pressure in the annular cavity is charged to an overpressure.

9. The riser tension protector according to claim 1, wherein respective upper ends of the cylinder barrels are interconnected by a cross member.

10. The riser tension protector according to claim 1 wherein the free ends of the piston rods are fixed to an upper frame section adapted for attachment to the top drive system.

11. A coiled tubing lift frame assembly comprising:

a frame having an upper frame section adapted for attachment to a top drive system and a lower frame section adapted to interface with a flowhead assembly;

a pair of pneumatic cylinders spaced apart from one another, the pneumatic cylinders having a respective cylinder barrel and a piston head and a piston rod translatable therein, a free end of the piston rods being fixed to the upper frame section and a lower end of the cylinder barrels being fixed relative to the lower frame section;

wherein the pneumatic pressure in the cylinders is charged to an over pressure sufficient to cause the piston rods to remain fully retracted and stationary in the barrels when an axial load is under a predetermined operating load threshold and to extend on an upheave of the floating vessel when the axial load exceeds the predetermined operating load threshold.

12. The assembly as defined in claim 11, wherein the upper frame section may be attached to the top drive system by means of coupling elements.

13. The assembly as defined in claim 11, wherein the lower ends of the cylinder barrels are fixed to the lower frame section by means of coupling elements.

14. The assembly as defined in claim 11, wherein the lower ends of the cylinder barrels are directly fixed to the lower frame section by means of coupling elements.

15. The assembly as defined in claim 14, wherein the lower end of the cylinder barrel defines a rigid section.

16. The assembly as defined in claim 15, wherein the lower end of the cylinder barrel defines a longitudinally extended rigid section.

17. The assembly as defined in claim 11, wherein respective upper ends of the cylinder barrels may be interconnected by a cross member.

18. A method for providing back up compensation for a riser used in operations on a floating vessel in the event of failure of a primary compensator of a derrick on a floating vessel during an upheave, the derrick having a top drive supporting a flow head assembly and a riser connected below the flow head assembly, the method comprising:

connecting the riser tension protector as defined in claim 1 between the top drive and the riser so that the pair of pneumatic cylinders of the riser tension protector is located between the top drive system and the flow head assembly in a manner whereby the free ends of the piston rods are operatively associated with the top drive system and the lower ends of the cylinder barrels are fixed relative to the flow head assembly;

charging the cylinders to a pneumatic pressure sufficient to cause the piston rods to remain fully retracted and stationary in the barrels when an axial load on the riser is under a predetermined operating load threshold and to extend on an upheave of the floating vessel when the axial load on the riser exceeds the predetermined operating load threshold; and, wherein in the event of failure of the primary compensator during an upheave of the vessel sufficient to cause the axial load on the riser to exceed the predetermined operating load threshold, the piston rods extend to compensate for the upheave of the floating vessel.

19. The method according to claim 18, comprising, upon initial extension of the pistons in response to the upheave, allowing the piston rods to extend or retract, respectively, thereby providing compensation on subsequent upheaves and down heaves, respectively, to maintain a relatively constant axial load on the riser.

20. The method according to claim 19, wherein variations in axial load are compensated for by gas compression and expansion in the cylinders.

* * * * *